US005814756A

United States Patent [19]

Boss

[11] Patent Number: 5,814,756

[45] Date of Patent: Sep. 29, 1998

[54] METHOD AND DEVICE FOR DETERMINING THE DISAGGREGATION TIME OF A PROGRAMMABLE PROJECTILE

[75] Inventor: André Boss, Zürich, Switzerland

[73] Assignee: Oerlikon Contraves AG, Zürich, Switzerland

[21] Appl. No.: 749,328

[22] Filed: Nov. 14, 1996

[30] Foreign Application Priority Data

Apr. 19, 1996 [CH] Switzerland ..... 1996 0999/96

[51] Int. Cl.[6] ..... F42C 9/00

[52] U.S. Cl. ..... 89/6.5; 235/408

[58] Field of Search ..... 89/41.01, 41.22, 89/6.5, 6; 73/417; 102/489, 357, 211; 235/408, 404, 411, 417, 407; 434/24

[56] References Cited

U.S. PATENT DOCUMENTS

| | | | |
|---|---|---|---|
| 3,575,085 | 4/1971 | McAdam, Jr. | 89/41.01 |
| 4,142,442 | 3/1979 | Tuten . | |
| 4,267,776 | 5/1981 | Eickerman | 102/215 |
| 4,283,989 | 8/1981 | Toulios et al. | 89/6.5 |
| 4,449,041 | 5/1984 | Girard . | |
| 4,750,423 | 6/1988 | Nagabhushan | 89/1.51 |
| 4,955,279 | 9/1990 | Nahrwold | 89/6.5 |
| 4,957,046 | 9/1990 | Puttock | 102/489 |
| 4,960,055 | 10/1990 | Dieval | 102/489 |
| 5,140,329 | 8/1992 | Maughan et al. | 342/67 |
| 5,413,029 | 5/1995 | Gent et al. | 89/41.3 |
| 5,497,704 | 3/1996 | Kurschner et al. | 102/264 |

FOREIGN PATENT DOCUMENTS

| | | | |
|---|---|---|---|
| 0300255 | 1/1989 | European Pat. Off. . | |
| 0467055 | 1/1992 | European Pat. Off. . | |
| 3309147 | 9/1984 | Germany | 89/6.5 |
| 2107835 | 5/1983 | United Kingdom . | |

OTHER PUBLICATIONS

Ground Firing Table, Anti–Aircraft Firing Table, Correction Tables, for 35 mm Oerlikon Ammunition; WWW 600 040 DE Sep. 1975.

"AHEAD–Skyguard Fire Control/35 mm Twin Gun Air Defence System Demonstration"; (OC 2052 e 94); Oerlikon–Contraves, Sep. 1993.

*Primary Examiner*—Harold J. Tudor
*Assistant Examiner*—Christopher K. Montgomery
*Attorney, Agent, or Firm*—Browdy and Neimark

[57] ABSTRACT

It is possible to improve the hit probability of programmable projectiles by means of this method. For this purpose a predetermined optimal disaggregation distance (Dz) between a disaggregation point (Pz) of the projectile (18) and an impact point (Pf) on the target is maintained constant by the correction of the disaggregation time (Tz) of the projectile (18). The correction is performed by adding a correcting factor, which is multiplied by a velocity difference, to the disaggregation time (Tz). The velocity difference is formed from the difference between the actually measured projectile velocity and a lead velocity of the projectile, wherein the lead velocity is calculated from the average value of a number of previous successive projectile velocities.

15 Claims, 3 Drawing Sheets

Figure 1:
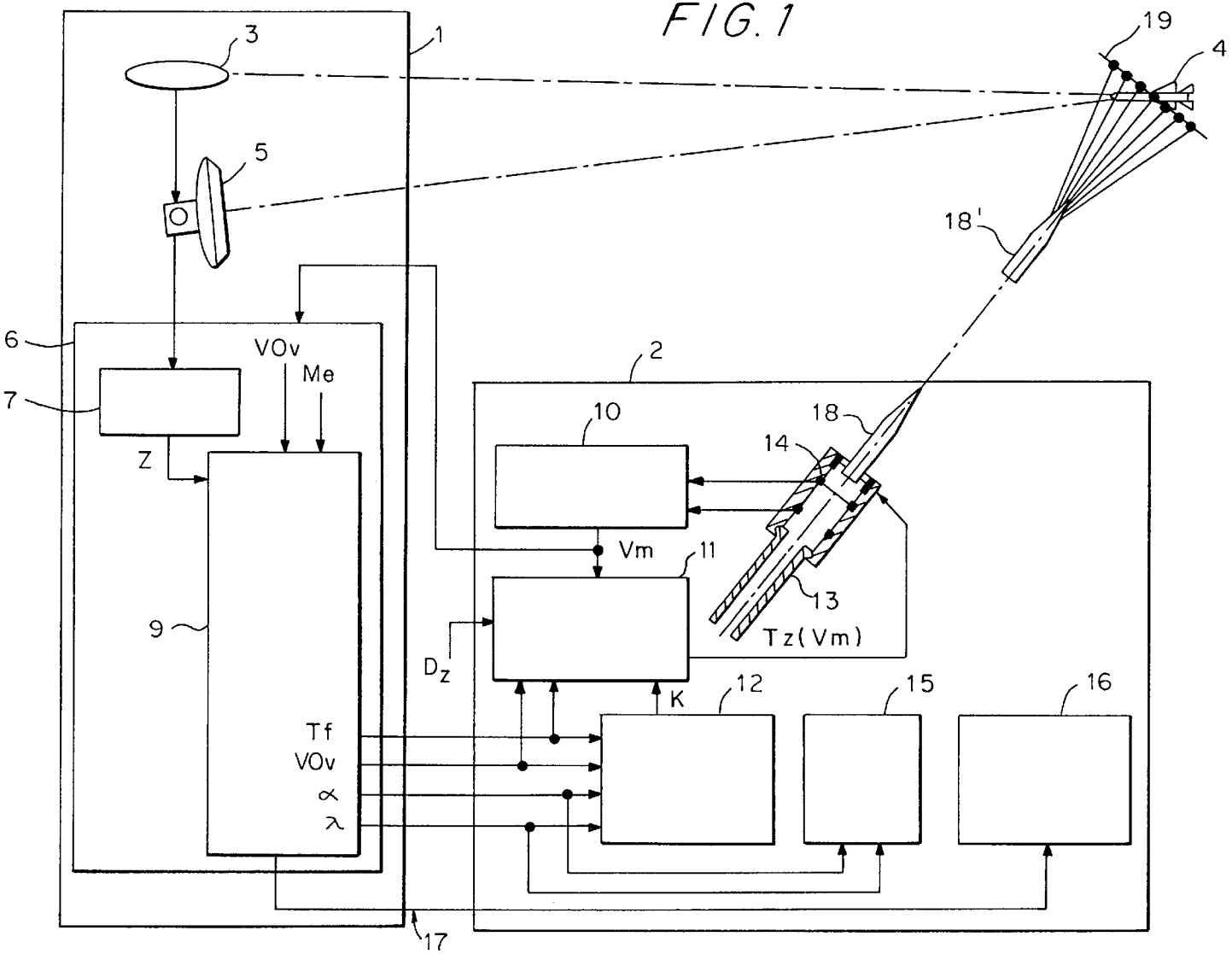

1
2
3
4
5
6
7
9
10
11
12
13
14
15
16
17
18
18'
19
Tz(Vm)
Vm
K
Dz
Z
VOv
Me
Tf
VOv
α
λ

METHOD AND DEVICE FOR DETERMINING THE DISAGGREGATION TIME OF A PROGRAMMABLE PROJECTILE

The invention relates to a process and device for determining the disaggregation time of a programmable projectile, wherein the calculation is at least based on an impact distance to a target determined from sensor data, a projectile velocity measured at the muzzle of a gun barrel and a predetermined optimal disaggregation distance between an impact point and a disaggregation point of the projectile.

A device has become known from European patent application 0 300 255 which has a measuring device for the projectile velocity disposed at the muzzle of a gun barrel. The measuring device consists of two toroid coils arranged at a defined distance from each other. Because of the change of the magnetic flux created during the passage of a projectile through the two toroid coils, a pulse is generated in each toroid coil in rapid succession. The pulses are provided to an electronic evaluation device, in which the velocity of the projectile is calculated from the chronological distance between the pulses and the distance between the toroid coils. A transmitter coil for the velocity is disposed behind the measuring device in the direction of movement of the projectile, which acts together with a receiver coil provided in the projectile. The receiver coil is connected via a high pass filter with a counter, whose output side is connected with a time fuse. A disaggregation time is formed from the calculated velocity of the projectile and an impact distance to a target, which is inductively transmitted to the projectile directly after the passage through the measuring device. The time fuse is set by means of this disaggregation time, so that the projectile can be disaggregated in the area of the target.

If projectiles with sub-projectiles are employed (projectiles with primary and secondary ballistics) it is possible, for example as known from pamphlet OC 2052 d 94 of the Oerlikon-Contraves company of Zürich, to destroy an attacking target by multiple hits if, following the ejection of the sub-projectiles at the time of disaggregation, the expected area of the target is covered by a cloud constituted by the sub-projectiles. In the course of disaggregation of such a projectile the portion carrying the sub-projectiles is separated and ripped open at predetermined breaking points. The ejected sub-projectiles describe a spin-stabilized flight path caused by the rotation of the projectile and are located evenly distributed on approximately semicircular curves of circles of a cone, so that a good probability of an impact can be achieved.

It is not always possible with the above described device to achieve a good hit or shoot-down probability in every case because of dispersions in the disaggregation distance caused, for example, by fluctuations of the projectile velocity and/or use of non-actualized values. Although the circle would become larger with larger disaggregation distances, the density of the sub-projectiles would become less. The opposite case occurs with shorter disaggregation distances: the density of the sub-projectiles would be greater, but the circle smaller.

It is the object of the invention to propose a process and a device in accordance with the preamble, by means of which an optimum hit or shoot-down probability can be achieved, while avoiding the above mentioned disadvantages.

This object is attained by the invention disclosed. Here, a defined optimal disaggregation distance between a disaggregation point of the projectile and an impact point on the target is maintained constant by correcting the disaggregation time. The correction is performed in that a correction factor multiplied by a velocity difference is added to the disaggregation time. The difference in the projectile velocity is formed from the difference between the actually measured projectile velocity and a lead velocity of the projectile, wherein the lead velocity of the projectile is calculated from the average value of a number of previous successive projectile velocities.

The advantages which can be achieved by means of the invention reside in that a defined disaggregation distance is independent of the actually measured projectile velocity, so that it is possible to achieve a continuous optimal hit or shoot-down probability. The correction factor proposed for the correction of the disaggregation time is merely based on the firing elements of the impact point in order to control the weapon, namely the gun angles $\alpha$, $\lambda$, the impact time Tf and the lead velocity VOv of the projectile. The possibility of a simple integration into already existing weapons control systems requiring a minimum outlay is provided with this.

Figure 2:
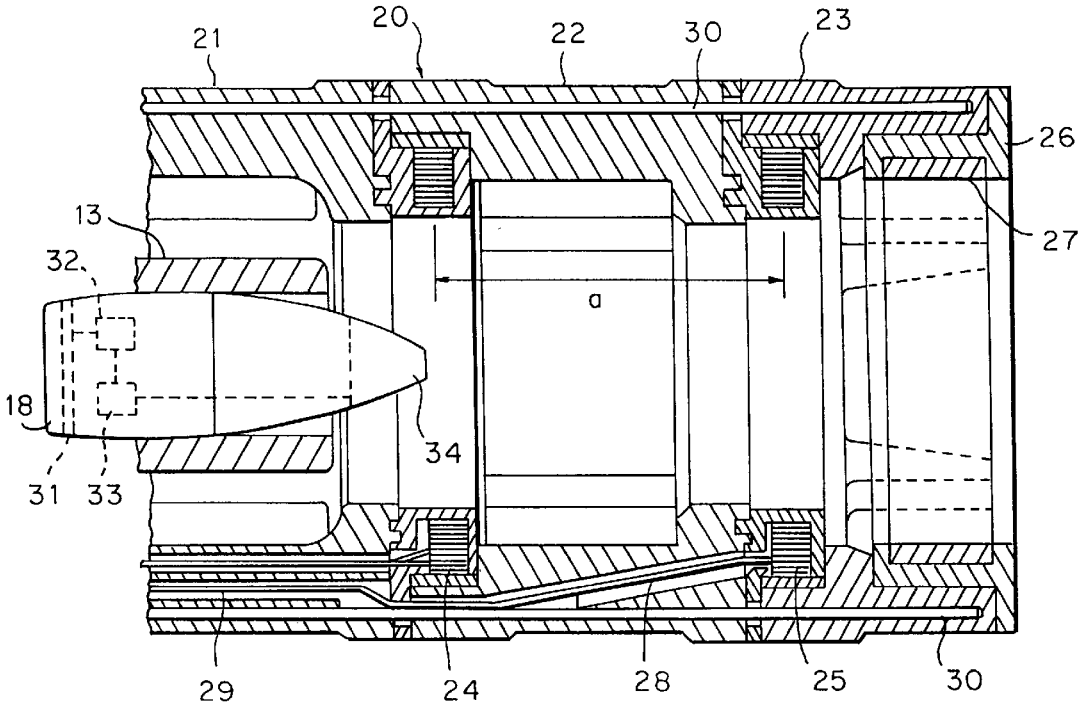
Figure 3:
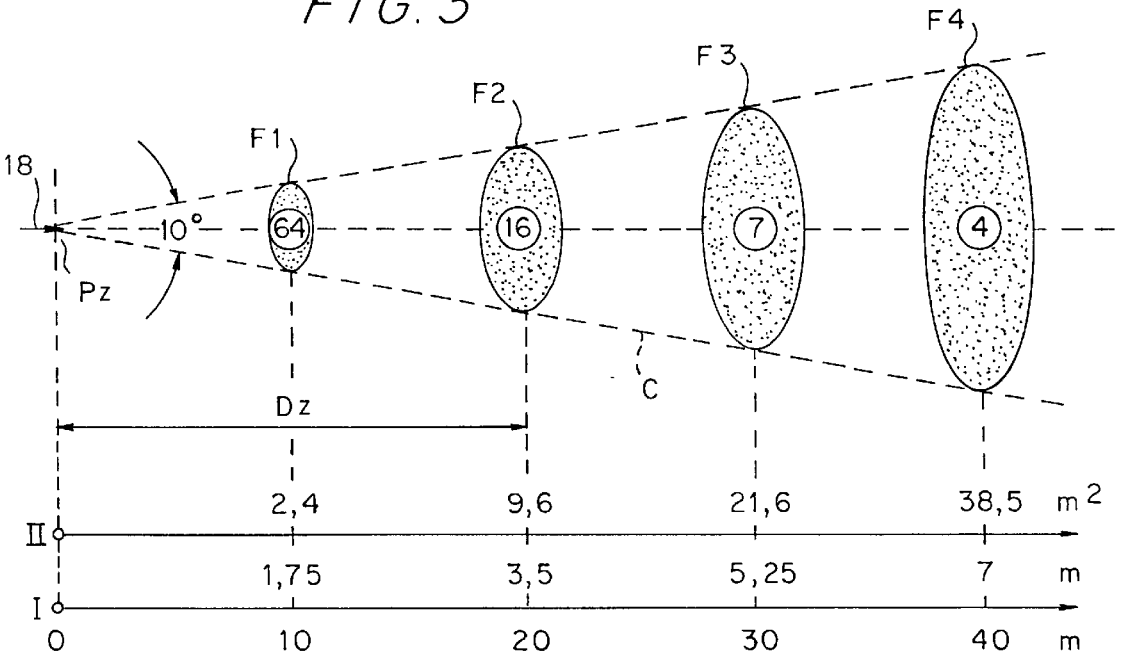
Figure 4:
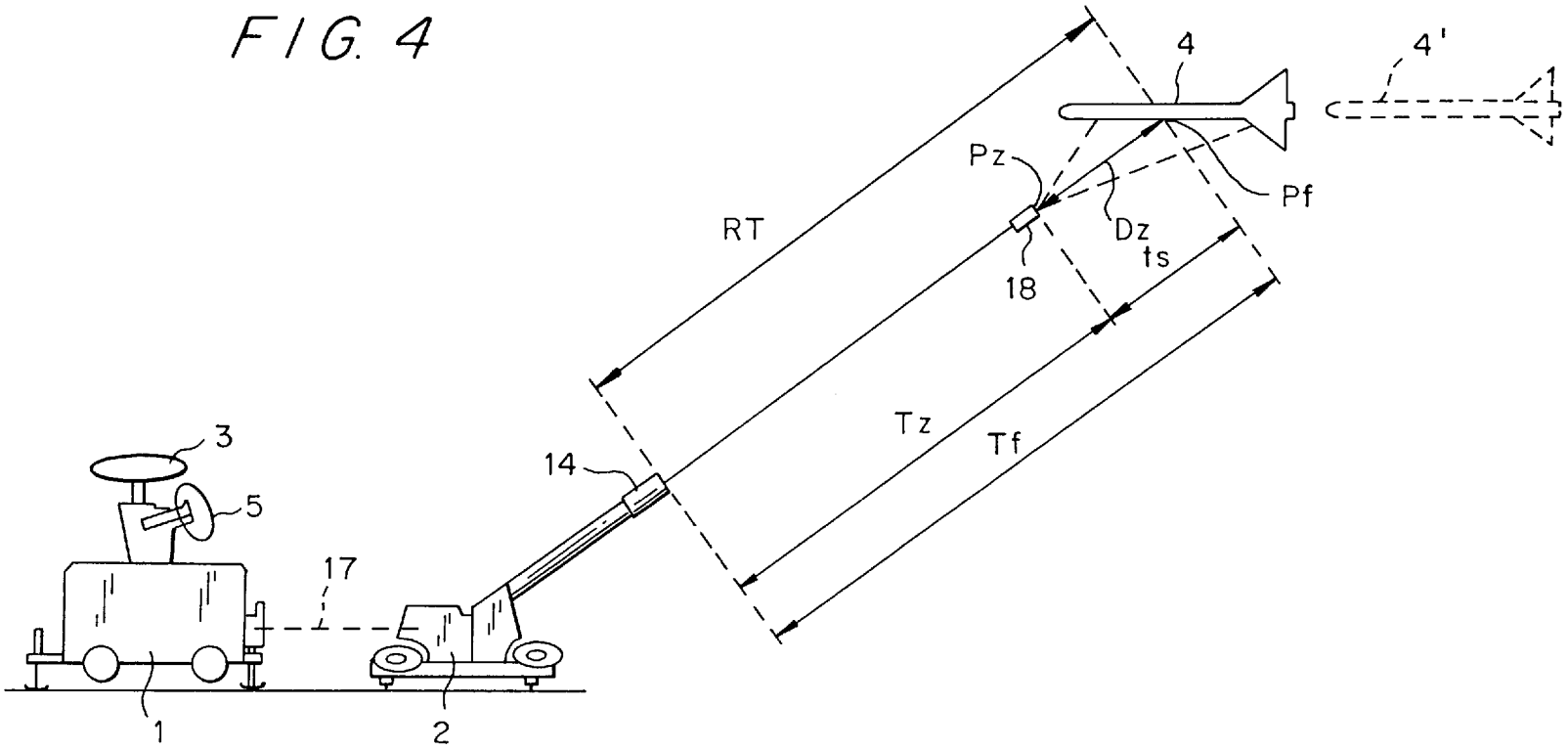

The invention will be explained in greater detail below by means of an exemplary embodiment in connection with the drawings. Shown are in:

FIG. 1 a schematic representation of a weapons control system with the device in accordance with the invention, FIG. 2 a longitudinal section through a measuring and programming device, FIG. 3 a diagram of the distribution of sub-projectiles as a function of the disaggregation distance, and FIG. 4 a different representation of the weapons control system in FIG. 1.

In FIG. 1, a firing control is indicated by 1 and a gun by 2. The firing control 1 consists of a search sensor 3 for detecting a target 4, a tracking sensor 5 for target detection connected with the search radar 3 for 3-D target following and 3-D target surveying, as well as a fire control computer 6. The fire control computer 6 has at least one main filter 7 and a lead computing unit 9. On the input side, the main filter 7 is connected with the tracking sensor 5 and on the output side with the lead computing unit 9, wherein the main filter 7 passes on the 3-D target data received from the tracking radar 5 in the form of estimated target data Z, such as position, velocity, acceleration, etc. to the lead computing unit 9. Meteorological data can be supplied to the lead computing unit 9 via a further input Me. The meaning of the identifiers at the individual junctions or connections will be explained in more detail below by means of the description of the functions.

A computer of the gun has an evaluation circuit 10, an update computing unit 11 and a correction computing unit 12. On the input side, the evaluation circuit 17 is connected with a measuring device 14 for the projectile velocity disposed on the muzzle of a gun barrel 13, which will be described in greater detail below by means of FIG. 2, and on the output side with the lead computing unit 9 and the update computing unit 11. On the input side, the update computing unit 11 is connected with the lead and with the correction computing units 9, 12, and is connected on the output side with a programming element integrated into the measuring device 14. The correction computing unit 12 is connected on the input side with the lead computing unit 9, and on the output side with the update computing unit 11. A gun servo device 15 and a triggering device 16 reacting to the fire command are also connected with the lead computing unit 9. The connections between the fire control 1 and the gun 2 are combined into a data transmission device which is identified by 17. The meaning of the identifiers at the individual connections between the computing units 10, 11, 12 as well as between the fire control 1 and the gun 2 will be explained in greater detail below by means of the description of the functions. A projectile is identified by 18 and 18' and is represented in a programming phase (18) and at the time of disaggregation (18'). The projectile 18 is a programmable projectile with primary and secondary ballistics, which is equipped with an ejection load and a time fuse and filled with sub-projectiles 19.

In accordance with FIG. 2, a support tube 20 fastened on the muzzle of the gun barrel 13 consists of three parts 21, 22, 23. Toroid coils 24, 25 for measuring the projectile velocity are arranged between the first part 21 and second and third parts 22, 23. A transmitter coil 27, contained in a coil body 26, is fastened on the third part 23—also called a programming part. The manner of fastening of the support tube 20 and the three parts 21, 22, 23 with each other will not be further represented and described. Soft iron rods 30 are arranged on the circumference of the support tube 20 for the purpose of shielding against magnetic fields interfering with the measurements. The projectile 18 has a receiver coil 31, which is connected via a filter 32 and a counter 33 with a time fuse 34. During the passage of the projectile 18 through the toroid coils 24, 25, a pulse is generated in rapid succession in each toroid coil. The pulses are supplied to the evaluation circuit 10 (FIG. 1), in which the projectile velocity is calculated from the chronological distance between the pulses and a distance a between the toroid coils 24, 25. Taking the projectile velocity into consideration, a disaggregation time is calculated, as will be described in greater detail below, which is inductively transmitted in digital form during the passage of the projectile 18 by means of the transmitter coil 27 to the receiver coil 31 for the purpose of setting the counter 32.

A disaggregation point of the projectile 18 is indicated by Pz in FIG. 3. The ejected sub-projectiles are located, depending on the distance from the disaggregation point Pz, evenly distributed on approximately semicircular curves of (perspectively drawn) circular surfaces F1, F2, F3, F4 of a cone C. The distance from the disaggregation point Pz in meters m is plotted on a first abscissa I, while the sizes of the surfaces F1, F2, F3, F4 are plotted in square meters $m^2$ and their diameters in meters m on a second abscissa II. With a characteristic projectile with, for example, 152 sub-projectiles, and a vertex angle of the cone C of initially 10°, the values plotted on the abscissa II result as a function of the distance. The density of the sub-projectiles located on the circular surfaces F1, F2, F3, F4 decreases with increasing distance and under the selected conditions is 64, 16, 7 and 4 sub-projectiles per square meter. With a predetermined disaggregation distance Dz of, for example 20 m, on which the calculation which follows has been based, a target area of the example used of 3.5 m diameter would be covered by 16 sub-projectiles per square meter.

The target to be defended against is identified by 4 and 4' in FIG. 4 and is represented in an impact and a launch position (4) and in a position (4') which precedes the impact or the launch position.

The above described device operates as follows:

The lead computing unit 9 calculates an impact distance RT from a lead velocity VOv and the target data Z of projectiles with primary and secondary ballistics, taking into consideration meteorological data.

For example, the lead velocity VOv is formed from the average values of a number of projectile velocities Vm supplied via the data transmission device 17, which have immediately preceded the actually measured projectile velocity Vm. Based on a preset disaggregation distance Dz and taking into consideration the projectile velocity Vg(Tf), which is a function of an impact time Tf, it is possible to determine a disaggregation time Tz of the projectile in accordance with the following equations:

$$Dz=Vg(Tf)*ts \text{ and } Tz=Tf-ts$$

wherein Vg(Tf) is determined by ballistic approximation and Tz means the flight time of the projectile to the disaggregation point Pz and ts the flight time of a sub-projectile flying in the projectile direction from the disaggregation point Pz to the impact point Pf (FIGS. 3, 4).

The lead computing unit 9 furthermore detects a gun angle α of the azimuth and a gun angle λ of the elevation. The values a, α, λ, Tz or Tf and VOv are called the fire data elements of the impact point and are supplied via the data transmission device 17 to the correction computing unit 12. The quantity a is the distance from the gun to the disaggregation point (or impact point). In addition, the fire data elements α and λ are also provided to the gun servo device 15, and the fire data elements VOv and Tz also to the update computing unit 11. If only primary ballistics are applied, the impact time Tf=Tz+ts is transmitted in place of the disaggregation time Tz (FIG. 1, FIG. 4).

The above described calculations are performed repeatedly in a clocked manner, so that the new data α, λ, Tz and VOv are available for a preset valid time in the respective actual clock period i.

Interpolation or extrapolation is respectively performed for the actual (current) time (t) between the clocked values.

At the start of each clock period i, the correction computing unit 12 calculates a correction factor K by means of the respectively latest set of fire data elements α, λ, Tz or Tf and VOv in accordance with the equation $$K=\frac{-(1+\delta TG/\delta to)*TG*(1+0{,}25*q*(VOv*Vn)^{1/2}*TG)}{(1+(TG*(1+0{,}5*q*(VOv*Vn)^{1/2}*TG)*\omega^2))*VOv}$$

Here, δTG/δto is the derivation of the flying time TG of the projectile in accordance with the time which is calculated from the equation $$\delta TG/\delta to=(TG_i-TG_{i-1})/to$$

wherein i is the actual clock period, i−1 the previous clock period and to is the length of a clock period, and wherein the flying time TG of a projectile is equal to the impact time Tf. $\omega^2$ is a value related to the position of the gun barrel 13, which is calculated in accordance with the equation $$\omega^2=(\text{rate}_\alpha*\cos\lambda)^2+(\text{rate}_\lambda)^2$$

wherein $\text{rate}_\alpha=(\alpha_i-\alpha_{i-1})/to$ und $\text{rate}_\lambda=(\lambda_i-\lambda_{i-1})/to$ identify the gun barrel angular velocities in the direction α or λ.

Vn is a standard velocity in ballistics.

q is a value which takes the air resistance of a projectile into consideration, which is calculated in accordance with the equation $$q=(CWn*\gamma*Gq)/(2*Gm),$$

wherein the meaning of the individual values to be inserted are as follows: $CW_n$ is a coefficient of air resistance; γ is air density; $G_q$ is the transverse cross-sectional area of the projectile taken perpendicular to the longitudinal axis; and $G_m$ is the mass of the projectile.

Instead of selecting a numerical (or, if required, a filtered) solution as explained above, it is also possible to read out the tachometer value ω directly at the gun and to use it for the calculation.

From the correction factor K supplied by the correction computing unit 12, from the actually measured projectile velocity Vm supplied by the evaluation circuit 10 and from the lead velocity Vov and disaggregation time Tz supplied by the lead computing unit 9, the update computing unit 11 calculates a corrected disaggregation time Tz(Vm) in accordance with the equation $$Tz(Vm)=Tz+K*(Vm-VOv).$$

The corrected disaggregation time Tz(Vm) is interpolated or extrapolated for the actual current time t depending on the valid time. The freshly calculated disaggregation time Tz(Vm, t) is provided to the transmitter coil 27 of the programming unit 23 of the measuring device 14 and is inductively transmitted to a passing projectile 18 as already previously described in connection with FIG. 2.

It is possible to maintain the disaggregation distance Dz (FIGS. 3, 4) constant independently of the fluctuation of the projectile velocity by means of the correction of the disaggregation time Tz, so that it is possible to achieve an optimal hit or shoot-down probability.

List of Reference Characters

1 Fire Control
2 Gun
3 Search sensor
4 Target
5 Tracking sensor
6 Fire control computer
7 Main filter
9 Lead computing unit
10 Evaluation circuit
11 Update computing unit
12 Correction computing unit
13 Gun barrel
14 Measuring device
15 Gun servo device
16 Triggering device
17 Data transmission device
18 Projectile
18' Projectile
19 Sub-projectile
20 Support tube
21 First part
22 Second part
23 Third part
24 Toroid coil
25 Toroid coil
26 Coil body
27 Transmitter coil
28 Line
29 Line
30 Soft iron rods
31 Receiver coil
32 Filter
33 Counter
34 Time fuse
a Distance
Pz Position of the disaggregation point
F1–F4 Circular surfaces
C Cone
I First abscissa
II Second abscissa
Dz Disaggregation distance
RT Impact distance
VOv Lead velocity
Vm Actual measured velocity
Tz Disaggregation time
ts Sub-projectile flying time
Pf Impact point
α Gun angle
λ Gun angle
Tf Impact time
TG Flying time
Tz(Vm) Corrected disaggregation time
Me Input (meterorol.)
Z Target data

I claim:

1. A process for determining the disaggregation time of a programmable projectile, wherein the calculation is at least based on an impact distance (RT) to a target determined from sensor data, a projectile velocity (Vm) measured at the muzzle of a gun barrel (13) and a predetermined disaggregation distance (Dz) between an impact point (Pf) and a disaggregation point (Pz) of the projectile (18), characterized in that the predetermined disaggregation distance (Dz) is maintained constant by a correction of the disaggregation time (Tz), wherein the correction is performed by means of the equation $$Tz(Vm)=Tz+K*(Vm-VOv)$$

and wherein

TZ(Vm) means the corrected disaggregation time,

Tz the disaggregation time,

K a correction factor,

Vm the actually measured projectile velocity, and

VOv a lead velocity of the projectile.

2. The process in accordance with claim 1, characterized in that

The correction factor (K) is calculated in accordance with the equation $$K=\frac{-(1+\delta TG/\delta to)*TG*(1+0{,}25*q*(VOv*Vn)^{1/2}*TG)}{(1+(TG*(1+0{,}5*q*(VOv*Vn)^{1/2}*TG)*\omega^2))*VOv}$$

wherein

TG means a flying time of the projectile,

δTG/δto the derivation of the flying time from the time, q a value taking the air resistance of the projectile into consideration, VOv the lead velocity of the projectile, Vn a standard velocity in ballistics, and $\omega^2$ a value relating to the position of the gun barrel.

3. The process in accordance with claim 2, characterized in that the calculations are repeated in a clocked manner.

4. The process in accordance with claim 3, characterized in that the derivation of the flying time (TG) is calculated in accordance with the equation $$\delta TG/\delta to=(TG_i-TG_{i-1})^{/to}$$

wherein i is the actual clock period, i−1 the previous clock period, and to the length of a clock period.

5. The process in accordance with claim 3, characterized in that the value ($\omega^2$) relating to the position of the gun barrel (13) is calculated in accordance with the equation $$\omega^2=(\text{rate}_\alpha{}^*\cos\lambda)^2+(\text{rate}_\lambda)^2$$

wherein $\alpha$ means a gun angle of the azimuth, $\lambda$ a gun angle of the elevation, $\text{rate}_\alpha$ a gun barrel angular velocity in the $\alpha$ direction, and $\text{rate}_\lambda$ a gun barrel angular velocity in the $\lambda$ direction.

6. The process in accordance with claim 5, characterized in that the gun barrel angular velocities in the $\alpha$ and $\lambda$ directions are calculated in accordance with the equations $$\text{rate}_\alpha=(\alpha_i-\alpha_{i-1})^{/to}$$

$$\text{rate}_\lambda=(\lambda_i-\lambda_{i-1})^{/to}$$

wherein i is the actual clock period, i−1 the previous clock period, and to the length of a clock period.

7. The process in accordance with claim 3, characterized in that the value (q) which tales the air resistance of the projectile into consideration is calculated in accordance with the equation $$q=(CWn^*\gamma^*Gq)/(2^*Gm)$$

wherein

CWn is a coefficient of the air resistance, $\gamma$ the air density,

Gq a projectile transverse cross section, and

Gm the mass of the projectile.

8. The process in accordance with claim 2, characterized in that the lead velocity (VOv) is formed from the average value of a number of measured projectile velocities which immediately precede the actually measured projectile velocity (Vm).

9. The process in accordance with claim 2, characterized in that the corrected disaggregation time Tz(Vm) is interpolated or extrapolated for the actual current time depending on a valid time.

10. A device for executing the process in accordance with claim 1, having a fire control computer (6) which is connected with a gun computer via a data transmission device (17), wherein the fire control computer (6) has at least one lead computing unit (9), and wherein the gun computer has at least one evaluation circuit (10) for determining the projectile velocity (Vm) and an update computing unit (11), which is connected on the input side with the evaluation circuit (10) for the purpose of supplying the projectile velocity (Vm) and which is connected at the output side with a programming element (23) of a measuring device (14) for the projectile velocity (Vm), characterized in that a correction computing unit (12) for calculating the correction factor (K) is provided, the correction computing unit (12) is connected on the input side with the lead computing unit (9) via the data transmission device (17) for the purpose of supplying the fire data elements of gun angle ($\alpha$, $\lambda$), lead speed (VOv) and disaggregation or impact times (Tz, Tf), on which the calculation is based, the update computing unit (11) is connected on the input side to the lead computing unit (9) via the data transmission device (17) for the purpose supplying the lead velocity (VOv) and the disaggregation or impact times (Tz, Tf) and is connected on the input side with the correction computing unit (12) for the purpose of supplying the correction factor (K), and the corrected disaggregation time Tz(Vm) determined in the update computing unit (11) is supplied to the programming element (23) via the connection with the output side of the update computing unit (11).

11. A process for determining a fuze time for disaggregation of a programmable projectile (18) shot from a gun barrel (13) toward a target, the process comprising:

measuring a projectile measured muzzle velocity (Vm);

determining, from target sensor data, an impact distance (RT) from the gun barrel to the target;

subtracting a predetermined disaggregation distance (Dz) from the impact distance, the predetermined disaggregation distance being a difference between an impact point (Pf) and a disaggregation point (Pz) of the projectile;

calculating as a function of the measured muzzle velocity a corrected disaggregation time Tz(Vm) according to $$Tz(Vm)=Tz+K\cdot(Vm-Vov)$$

where Vov is a projectile average muzzle velocity, Tz is a nominal disaggregation time corresponding to the projectile average muzzle velocity, and K is a correction factor;

and wherein the correction factor K is an algebraic function of physical quantities.

12. The process in accordance with claim 11, wherein the projectile average muzzle velocity is an average of previously measured muzzle velocities (Vm).

13. The process in accordance with claim 11, wherein the physical quantities include a squared angular velocity of the gun barrel $\omega^2$.

14. The process in accordance with claim 11, wherein the physical quantities do not include the actually measured projectile velocity Vm.

15. The process in accordance with claim 11, comprising a step of interpolating between calculated values of a flying time.

* * * * *